US008757173B2

(12) United States Patent
Kovarik et al.

(10) Patent No.: US 8,757,173 B2
(45) **Date of Patent: *Jun. 24, 2014**

(54) NAIL POLISH REMOVER METHOD AND DEVICE

(71) Applicants: Katherine Rose Kovarik, Englewood, CO (US); Joseph E. Kovarik, Englewood, CO (US)

(72) Inventors: Katherine Rose Kovarik, Englewood, CO (US); Joseph E. Kovarik, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/079,054

(22) Filed: Nov. 13, 2013

(65) Prior Publication Data

US 2014/0060564 A1 Mar. 6, 2014

Related U.S. Application Data

(63) Continuation of application No. 13/425,913, filed on Mar. 21, 2012, now Pat. No. 8,584,685.

(60) Provisional application No. 61/467,767, filed on Mar. 25, 2011.

(51) Int. Cl.
*A45D 29/00* (2006.01)

(52) U.S. Cl.
USPC ..... 132/200; 132/74.5; 132/285

(58) Field of Classification Search
USPC ..... 132/200, 73, 73.5, 74.5, 285, 319, 320
See application file for complete search history.

(56) References Cited

U.S. PATENT DOCUMENTS

| | | | | |
|---|---|---|---|---|
| 3,014,579 | A | | 12/1961 | Lathrop |
| 3,124,825 | A | | 3/1964 | Iovenko |
| 3,369,553 | A | | 2/1968 | Keesee |
| 3,598,685 | A | | 8/1971 | Lee et al. |
| 3,645,835 | A | * | 2/1972 | Hodgson ..... 428/195.1 |
| 4,619,253 | A | | 10/1986 | Anhauser et al. |
| 4,696,393 | A | | 9/1987 | Laipply |
| 4,800,904 | A | * | 1/1989 | Kinseley et al. ..... 132/73.5 |
| 4,844,885 | A | * | 7/1989 | Chernack ..... 424/61 |
| 4,938,347 | A | | 7/1990 | Tillman |
| 5,026,541 | A | | 6/1991 | Lanier |
| 5,320,217 | A | | 6/1994 | Lenarz |
| 5,415,903 | A | | 5/1995 | Hoffman et al. |
| 5,525,389 | A | | 6/1996 | Hoffman et al. |
| 5,558,700 | A | | 9/1996 | Shibahashi et al. |
| 5,823,203 | A | | 10/1998 | Carroll et al. |

(Continued)

OTHER PUBLICATIONS

"Magis™ Foil Nail Wraps—Products," Magis Supplies Ltd., 2013, [retrieved on Dec. 30, 2013], 2 pages. Retrieved from: www.foilnailwraps.com/products.

(Continued)

*Primary Examiner* — Robyn Doan
*Assistant Examiner* — Tatiana Nobrega
(74) *Attorney, Agent, or Firm* — Sheridan Ross P.C.

(57) ABSTRACT

Nail polish remover strips are pre-sized for toe or fingernails and applied to a painted or artificial nail and left thereon for a predetermined period of time to dissolve the nail polish and/or nail bonding agent. Preferably a color change occurs to depict the appropriate dwelling time to dissolve the nail polish. Certain embodiments include odor reducing components. Preferably the strips are layered composites having an exterior odor impervious material, a layer of encapsulated acetone or nail polish removing agent, an absorbent layer, and a peelable backing, with the strips being curved to accommodate contact with a person's nail.

21 Claims, 4 Drawing Sheets

(56) References Cited

U.S. PATENT DOCUMENTS

| | | | | |
|---|---|---|---|---|
| 5,924,428 | A | 7/1999 | Song | |
| 6,016,915 | A | 1/2000 | Almond | |
| 6,060,073 | A | 5/2000 | Keller | |
| 6,305,383 | B1 * | 10/2001 | Thoma | 132/200 |
| 6,367,485 | B1 | 4/2002 | Dutton-Davis et al. | |
| 6,405,735 | B1 * | 6/2002 | Dockery | 132/74.5 |
| 6,481,443 | B1 | 11/2002 | Moore-Johnson et al. | |
| 6,586,529 | B2 | 7/2003 | Mumick et al. | |
| 6,634,367 | B2 * | 10/2003 | Abraham et al. | 132/74.5 |
| 6,662,807 | B2 | 12/2003 | Meinschewnk | |
| 6,901,935 | B2 | 6/2005 | Chang | |
| 6,988,502 | B2 | 1/2006 | Tsukamoto | |
| 6,990,985 | B1 | 1/2006 | Allen et al. | |
| 7,806,877 | B2 | 10/2010 | Kang et al. | |
| 8,513,322 | B2 * | 8/2013 | Wright et al. | 522/153 |
| 8,584,685 | B2 | 11/2013 | Kovarik et al. | |
| 2003/0127104 | A1 | 7/2003 | Tyre | |
| 2004/0142830 | A1 | 7/2004 | Tavares | |
| 2006/0283470 | A1 | 12/2006 | Keogh | |
| 2007/0107745 | A1 | 5/2007 | Kiyomoto | |
| 2007/0287647 | A1 | 12/2007 | Hadry | |
| 2008/0039812 | A1 | 2/2008 | Kang | |
| 2008/0041404 | A1 | 2/2008 | Vo | |
| 2008/0060550 | A1 | 3/2008 | MacDonald | |
| 2008/0142405 | A1 | 6/2008 | Knapp | |
| 2010/0083974 | A1 * | 4/2010 | Milican | 132/73 |
| 2010/0175942 | A1 | 7/2010 | Griep et al. | |
| 2010/0204076 | A1 | 8/2010 | Cheng | |
| 2010/0275942 | A1 * | 11/2010 | Barile | 132/200 |
| 2010/0305491 | A1 | 12/2010 | Bschnagel | |
| 2011/0284017 | A1 * | 11/2011 | Nakamura | 132/73 |
| 2012/0305019 | A1 * | 12/2012 | Barile | 132/200 |
| 2013/0074859 | A1 | 3/2013 | Horvath et al. | |

OTHER PUBLICATIONS

Official Action for U.S. Appl. No. 13/425,913 mailed Feb. 15, 2013, 11 pages.

Notice of Allowance for U.S. Appl. No. 13/425,913 mailed Sep. 16, 2013, 14 pages.

* cited by examiner

"PRIOR ART"

NAIL POLISH REMOVER METHOD AND DEVICE

RELATED APPLICATIONS

This application is a continuation of U.S. patent application Ser. No. 13/425,913 filed on Mar. 21, 2012 (now U.S. Pat. No. 8,584,685, issued Nov. 19, 2013), which claims priority from U.S. Provisional Patent Application No. 61/467,767 filed on Mar. 25, 2011. The entire disclosure of the prior applications are considered to be part of the disclosure of the accompanying application and are hereby incorporated by reference.

FIELD OF THE INVENTION

The present invention relates to nail polish remover strips, and more particularly to fingernail and toe nail sized tabs or strips that can be applied to a painted or artificial nail and left thereon for a predetermined period of time to dissolve the nail polish and/or nail bonding agent.

BACKGROUND OF THE INVENTION

Fingernail polish and artificial fingernails are in widespread use as cosmetic enhancements, and are applied by the consumer as well as by professionals in salons. Artificial fingernails are typically produced either by gluing on premanufactured acrylic fingernails, or built up using an artificial fingernail form to apply layers of acrylic materials that are shaped to form an artificial fingernail. Although modern materials and methods enable very real looking artificial fingernails to be produced, it is necessary to periodically repair or remove the artificial fingernails. Artificial nails such as, for example, acrylic, gel or silk, linen or fiberglass wraps, have become popular and such products are applied or bonded onto the natural nail to provide a uniform appearance and then a nail polish or lacquer is applied to provide color and/or to cover the sculpting product used to form the artificial nail. Nail polish or lacquer products are applied as a temporary decoration and/or to improve the strength of the underlying nail. Such nail polishes or lacquers are removed using commercially available solvents in the form of nail polish removers.

Changing or removing a colored polish or lacquer from artificial nails can be difficult since most commercially available nail polish removers may damage the underlying sculpting product.

Artificial fingernails and fingernail polish are generally removed by immersing the wearer's fingertips in a solvent to soften and dissolve the polish and the glues and acrylics comprising the artificial fingernails. Acetone is generally used as the solvent. Acetone is a volatile material and evaporates quickly, producing gaseous compounds that may irritate the throat, lungs and eyes of exposed individuals. Further, acetone may damage adjacent furniture, carpet and other objects if it is spilled or splashed onto these surfaces. Exposure to the gaseous compounds resulting from use of acetone generally does not pose a problem for the average consumer, since the consumer is only relatively infrequently exposed to these compounds. However, professional manicurists and beauticians may be exposed to acetone on a daily basis. Over time, contact with acetone can pose a serious health hazard.

Various devices have been developed in the prior art in order to facilitate the removal of fingernail polish and artificial fingernails, and especially to reduce the hazards associated with the use of strong solvents to remove the fingernail polish and artificial fingernails. Many of these prior art device utilize covers to minimize evaporation of the solvent and to minimize exposure of the manicurist or wearer to the solvent. Other devices include sponges, brushes or other scuffing materials to hasten softening and removal of the fingernail polish and/or artificial fingernails.

The task of removing nail polish typically involves administering the nail polish remover onto a human nail or artificial nail through the use of a cotton ball and rubbing the cotton ball containing nail polish remover on the human nail or artificial nail until the nail polish has been removed. Soaking in such solutions is often employed, exposing not only the finger or toenail surface but also the surrounding skin regions that never had any polish associated therewith. Absorbing such agents into the skin around the nail is something many wish to avoid. Methods of removing nail polish or false nails is often an arduous and messy procedure. There is a long felt but unsolved need for an inexpensive, easy safe and repeatable way to remove nail polish and artificial nails, especially one where both the customer and the nail professional are not unduly exposed to the often unpleasant and unhealthy odors, fumes and smells of nail polish removal substances.

Accordingly, there is need for a method and apparatus for removing fingernail polish and artificial fingernails simultaneously from plural fingers, which is simple and inexpensive to manufacture, and which may be easily and comfortably used to remove fingernail polish and/or artificial fingernails from a wide range of different size hands.

SUMMARY OF THE INVENTION

The present invention is directed to nail polish removing strips that can be applied to the surface of a polished nail and remain there until the polish is dissolved sufficiently to have it removed. In one embodiment a color change is relied upon to signal to a person that the strip has been in place on the polished nail (or artificial nail) for a sufficient and predetermined time, namely a time sufficient to permit the chemical dissolution of the polish or adhesives sought to be removed from the person's nail.

The present invention in certain embodiments includes either an acetone based solution to remove nail polish or non-acetone based polish removers. Solvents such as acetates, acetones and acetonitriles can weaken and/or dissolve the resins or sculpting products used to form and/or bond the artificial nail to the natural nail. In other contexts, there is a need to remove polish from artificial nails without damaging or compromising the integrity of the resins or sculpting products used to form the artificial nail. Such a nail removal substance is retained primarily in a pad or absorbent region that is positioned next to a person's nail for a predetermined period of time sufficient to largely or completely remove polish associated with the nail. The removal substance is preferably contained in-between an outer odor reducing layer and a removable strip laminate. Once removed, the strip laminate thus exposes the nail polish removing saturated pad to the nail polish surface. Preferably adhesive is employed to maintain the strip in place for a predetermined time to permit the nail polish to be dissolved. Such adhesive may be provided along the periphery of the strip so that the majority of the nail contacting surface does not have adhesive—and so that the adhesive is not also dissolved prior to the strip being in pace for the desired amount of time. In other embodiments a color change is relied upon to signal to a person that the strip has been in place on the polished nail (or artificial nail) for a sufficient and predetermined time. Such color change can be for the entire strip; it may be for a portion of the strip (e.g. such as a portion that is not also involved in the provision of nail polish removing material to the nail—and thus is merely associated with the removal of the bottom laminate to trigger a time frame within which a color change will occur. The purpose of the color change is to warn a person that the nail polish removal substance or agent has been in place a predetermined period of time.

The type of amount of nail polish remover that can be used with the present invention can vary depending on many factors, such as a preference, whether there is a sensitivity to any particular agent, etc. As for non-acetone remover compositions, one alkyl nitrite solvent that is suitable includes isobutyl nitrite. Isobutyl nitrite has the chemical formula C.sub.4H.sub.9NO.sub.2 and can be alternatively referred to as nitrous acid, isobutyl ester; nitrous acid, 2-methylpropyl ester; and IBN. Isobutyl nitrite is very stable and has a moderate toxicity level. In particular, isobutyl nitrite has an inhalation toxicity level of about 600 ppm in vapor which makes it less toxic than previous nail polish removers. For example, acetonitrile, which has an inhalation toxicity level of about 60 ppm in vapor, is ten times more toxic than isobutyl nitrite. Thus, in accordance with certain embodiments, a vapor phase of the nail polish remover suitably includes less than about 600 ppm isobutyl nitrite.

Isobutyl nitrite has a pleasant and fruity odor. Preferably, the nail polish remover includes isobutyl nitrite that is greater than or equal to about 20% pure isobutyl nitrite, and even more preferably includes isobutyl nitrite greater than or equal to about 50% pure isobutyl nitrite, and even more preferably at least about 80% to about 95% by volume isobutyl nitrite. Nail polish removers generally contain acetone, acetonitriles, benzene, aromatic nitrites, alcohol and/or ethyl acetate as the active ingredient. Still others comprise ethyl acetate, acetone and/or acetonitrile-free nail polish remover containing isobutyl nitrite and butylated linseed oil for removing nail polish.

Still other non-acetone containing nail polish removers have a reduced level of toxicity and a more pleasing odor.

Compositions included with the present invention include a hygroscopic stabilizer to reduce degradation of the nail polish remover and/or individual components or ingredients in the nail polish remover upon exposure to aqueous media. In preferred embodiments, the nail polish remover includes or contains about 0.25% to about 2% by volume hygroscopic stabilizer, such as butylated linseed oil. It can also include one or more inactive ingredients such as sodium bicarbonate, silicone, isobutyl alcohol, calcium chloride, and water. a plastic sleeve containing glass ampoule, or similar tool.

In one embodiment, a strip of the present invention is contacted with a polished nail for a period of at least about 3 minutes, more preferably at least about 5 minutes, and less than about 10 minutes.

Preferably the strips have both desired adhesive qualities so that they remain in place on a nail for the desired period of time, as well as having the polish-dissolving abilities conferred by the active agents, such as acetone or non-acetone polish removing compositions.

In one particular embodiment, clear or substantial transparent strips have either acetone or non-acetone compositions provided with either both sides of a dual-layered strip (with polish removing compounds provided therebetween) and the strip is positioned on the surface of a nail to permit the polish removing composition to dissolve nail polish it comes into contact with. In one particular embodiment, when clear nail polish is removed, a color change agent or indicator is provided so that after about 5 minutes of contact between the strip and the polished nail, there is a color change sufficient to indicate to the person to whom such strip has been applied to appreciate that such time period has passed and is presumably sufficient to have removed and/or substantially dissolved the nail associated polish. In certain embodiments, the top most cover contains a color change agent such that when the acetone beads are crushed, thereby releasing the acetone into the below absorbent pad, the acetone also reacts with color change agents associated with a top cover and/or the absorbent pad, such that a user can discern a color change after a predetermined amount of time. Such time period can be set through adjusting chemical reaction between the acetone and a color change agent such that, for example, after about five minutes, the color change takes effect so that a user will appreciate and notice that such time period has expired and thus the nail polish removing device should be detached from the person's nail to thereby avoid any unpleasant and/or undesired further contact between the person's nail/skin and the acetone (or any other nail polish removing agent). One of skill in the art will appreciate that the top cover of the device as pictured in FIG. 6 can be transparent and/or in itself may be of a particular color. Preferably, the top most cover is substantially transparent such that not only the crushing and frangible nature of the nail polish containing beads can be discerned (thus ensuring that substantially all beads are crushed to release the nail polish removing material), but such transparency also facilities detecting the timed color change after a predetermined amount of time from the fracturing of the nail polish containing beads and the reaction with the color change agent. One of skill in the art will appreciate that the color change agent can again be associated with the top cover, the absorbent pad, the layer upon which nail polish removing beads are affixed, or otherwise. The important aspect is that a color change is perceived at a predetermined time and this aspect of the present embodiments provides a built in safety feature so that the strips are not misused, either consciously or unconsciously by a user or professional nail cosmologist. One will also appreciated, however, that other color changing methods and devices can be employed in association with various aspects of the present invention. For example, the top cover can in addition contain a layer that once removed changes color in about five minutes, whether or not such color change is directly associated with a chemical reaction with a nail polish removing substance, such as acetone.

A reagent, such as sodium nitroprusside may react with an acetone or an associated component, such as typically acetoacetic acid, to form a purple complex with the reagent. A reagent color change from pink to shades of increasingly dark purple provides a rough quantitative measure of acetone. The reactive ingredients of the reagent may be, for example, urease and bromthymol blue under a permeable membrane. The urease reacts with the urea to hydrolyze the urea to carbon dioxide and ammonium hydroxide. The liberated ammonium hydroxide increases the pH and the shift in alkalinity is indicated by the change in hue of the bromthymol blue. To achieve the range desired, the reagent zone may be impregnated with 3.2 I.U. of urease and 33 mcg. bromthymol blue. A non-reactive yellow dye may also be added to the reagent to provide a convenient color scale change from yellow through green to dark blue-green for comparison with a color block grid.

As depicted in certain of the figures, in a preferred embodiment the nail polish removing strips and/or pads are individually curved so as to approximate the curvature of a person's nails. This facilitates a more rigid provision of nail polish removing strips or pads and avoids the undesired planar or flat nature of a pad that may detract from desired surface contact with a person's nail once in place. Preformed curved pads or strips also may eliminate or reduce the need for adhesives to secure the nail polish removing strips or pads for the predetermined amount of time that contact is required with a person's nail to remove nail polish associated therewith. In other words, the curvature of the pad or strip itself may facilitate placement and retention of the nail polish removing device on the nail even without any application of any adhesive. In still other embodiments, placement and retention of the nail polish removing device on the nail even without any application of any adhesive. In still other embodiments, rubber bands, bandages, or other adhesive devices can be employed in addition to the present device to secure individual strips or pads around a person's finger or toe if a more secure attachment is desired. In still other embodiments, the strips are flexible and/or deformable so that they maintain a desired curve once applied to a nail, thus assisting in holding the strip in contact with the nail, either with or without adhesives.

The typical need to rub acetone repeatedly on a polished nail to remove undesired old polish is difficult if not impossible for older adults. Thus, such individuals are compelled to have another person, typically a professional pedicurist or nail salon employee, thus resulting in a more expensive endeavor. Thus, there is a need for more aged or less flexible adults to remove nail polish off of their toes in a fashion that does not involve the sustained contortions typically required to rub cotton balls soaked in acetone or other polish removal agents on one's toenails.

BRIEF DESCRIPTION OF THE DRAWINGS

FIG. 4 is a side view of one embodiment of a strip where an outer layer precludes escape of vapors emanating from the nail polish removing agent; the adhesive layer or portion is adjacent the other side's protective and removable layer, and the nail polish removing agent is contained there between.

DETAILED DESCRIPTION OF PREFERRED EMBODIMENT

Figure 1:
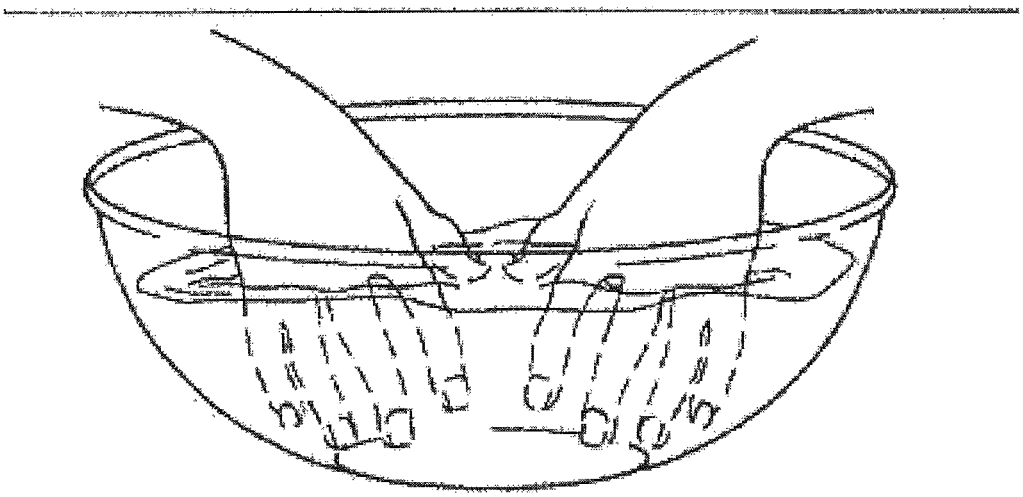
FIG. 1 is a view of prior art methods of removing fingernail polish.
Figure 2:
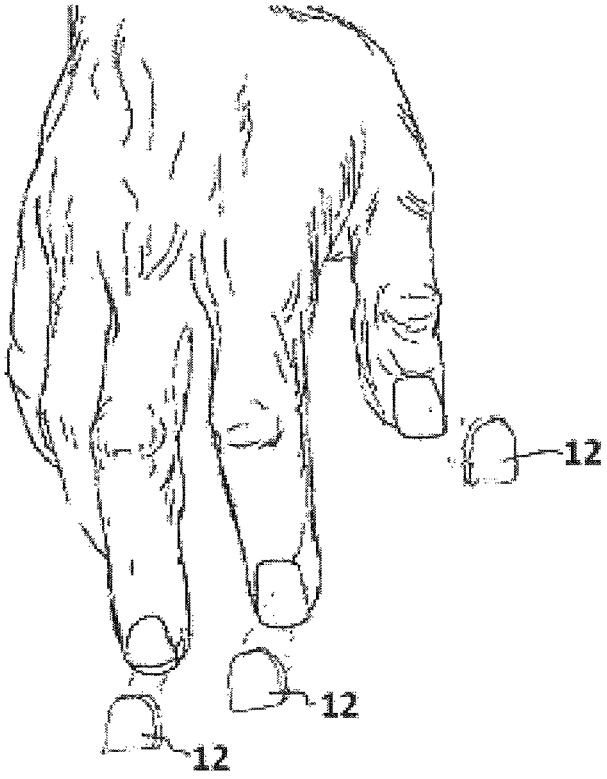
FIG. 2 is a perspective view of a fingernail with an adhesively associated strip of the present invention.
Figure 3:
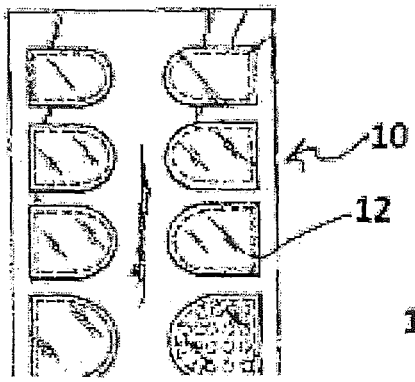
FIG. 3 is an illustration of a pre-made sheet of fingernail strips that can be dissociated with the sheet and individually applied to fingernails.
Figure 4:
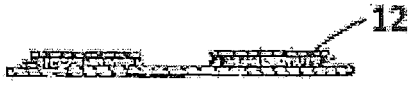
Figure 5:
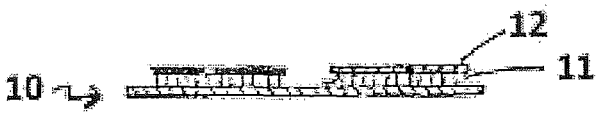
FIG. 5 is a side view of one embodiment where polish removing agent is encapsulated into small beads.
Figure 6:
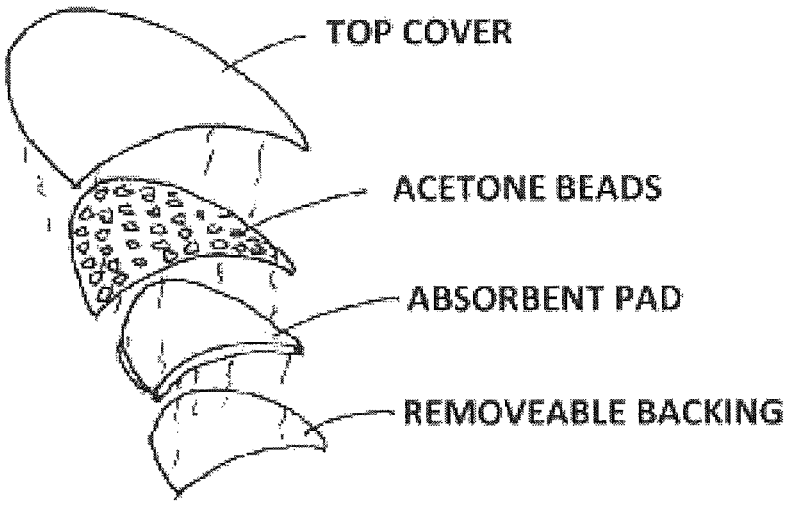
FIG. 6 is an exploded view of one embodiment of the present invention showing a top cover, a layer of acetone beads, an absorbent pad beneath the same and a removable backing associated therewith.

The present invention is generally a nail polish removal system shown in the figures. The system 10 includes multiple strips having associated pads impregnated with either an acetone-based or non-acetone based solvent that is effective at dissolving nail polish. Depending on what types of nails are put in contact with the pads 12, such as natural or synthetic nails, the type of solvent to be applied is significant. Although other solvent formulations are contemplated by the present invention, the solvent formulation of the preferred embodiment is preferably acetone based, as it has outperformed most non-acetone based formulations, However, the present invention is not limited to the use of acetone containing formulations and includes, for example, other formulations including a mixture of methylacetyl, dimethylketal, and deionized water. A feature of the present invention is the use of an effective amount of solvent in combination with pads 12 to achieve removal of nail polish with the amount of solvent with which pads 12 are impregnated preferably being predetermined and controlled so that excess solvent does not create droplets or spillage from pads 12.

Strips are preferably sized and shaped to match up with a person's fingernails or toenails, and as such, different sized versions of pre-fabricated strips are contemplated as a best mode for distribution and use. Preferably the strips are relatively thin and include a pad having a diameter of at least 7.5 centimeters. The thickness of pads 12 is sufficient to contain the amount of polish removing solvent, and thus may vary due to the particular solvent used. In most embodiments, however, the strips and associated pads are preferably between 0.5 millimeter and 3 millimeters, more preferably less than about 2 millimeters, and more preferably less than 1 millimeter. Although other types of fabrics or materials are contemplated, such as cotton based materials, pads 12 are preferably made of spunlaced fabric. The use of spunlaced fabric avoids fibers or filaments from becoming attached to the nails during the nail polish removal process, which can thereafter hinder smooth polishing and/or require additional labor to achieve clean nails. Furthermore, the spunlaced fabric is soft and pliable. These features enhance the nail polish removal process because the user can more easily manipulate the pads to effectively and accurately remove the nail polish.

The dimensions of pads are predetermined to easily cover the entire nail to achieve maximum contact between the impregnated solvent and the nail. It will be apparent to those skilled in the art of nail polish removal systems that many modifications and substitutions can be made to the preferred embodiment described above without departing from the spirit and scope of the present invention.

One particularly desirable aspect of many of the embodiments of the present invention is the reduction in undesired odor or fumes arising from the conventional or typical methods used to remove finger and toe-mail polish and artificial nails. For example, the covering provided that overlies the saturated pads of nail-polish removing formulations precludes a significant amount of vapors form otherwise being evaporated into the air, thus reducing the air around the nail customer, as well as the nail clinician, from breathing in such fumes. This has an especially advantageous safety aspect to various embodiments of the present invention. More than one odor-reducing layer can be employed and the various embodiments may employ at least two, at least three or at least four separate layers of material over-lying the absorbent pad material that contains the nail polish removing agents. Such layers may be of the same or similar material, or may be selected for their distinct properties, such as flexibility, ability to avoid having odorous materials from passing there through; their porosity; their color, brittleness; degradability, etc. In certain embodiments, the nail polish removing agent is in a gelled or semi-solid state such that it does not drip or move from the strip/pad, but rather remains adhered to the same so that it can be placed or positioned appropriately on a nail surface, where it can contain and direct nail polish remover to the nail surface to dissolve the layer of polish thereon.

In various embodiments, the nail removal strips or tabs are provided with an easily gripped, packet of individual or multiple tabs/strips such that the protective backing of each tab (or a set thereof) is able to be removed to expose the adhesive bonding surface that is itself associated with the nail polish removing surface of the nail polish removal device.

In other embodiments, the nail-polish removing agent can be encapsulated in a frangible shell or small enclosure so that it is not released in a fashion that can be absorbed by the pad fabric or other material until desired. Thus, as shown in some of the figures, small acetone containing beads 11 can be provided between two layers, with an upper layer being of a substantially odor impervious material and the lower material of the lower layer being removable so that when it is, the beads are amenable to being broken or fractured, thus releasing their contents onto both the nail surface and or into an adjacent absorbent pad, such pad associated with the top layer.

For ease of complying with written description and enablement requirements, the following references are incorporated herein in their entireties, especially as it relates the various acetone-based and non-acetone based compounds and solutions and formulations that can be employed in various embodiments of the present invention: U.S. Pat. No. 5,823,203 to Carroll et al., U.S. Pat. No. 6,367,485 to Dutton-Davis et al.; 20030127104 to Tyre; 20060283470 to Keogh; 20070107745 to Kiyomoto; 20070287647 to Hadry; 20080142405 to Knapp; 20100204076 to CHENG; 20100305491 to Baschnagel; 20080060550 to MacDonald; U.S. Pat. No. 7,806,877 to Kang et al.; U.S. Pat. No. 4,800,904 to Kinseley et al.; U.S. Pat. No. 4,619,253 to Anhauser et al.; U.S. Pat. No. 5,924,428 to Song; U.S. Pat. No. 6,990,985 to Allen et al.; U.S. Pat. No. 6,060,073 to Keller; and U.S. Pat. No. 5,415,903 and U.S. Pat. No. 5,525,389 to Hoffman et al. Also incorporated by reference herein in their entireties are the following issued patents and published applications: 20040142830 to Tavares; 20080039812 to Kang; U.S. Pat. No. 4,696,393 to Laipply.

In one embodiment, the present invention includes a nail cover of a material sized to proximate the size of a user's fingertip or toenail and configured to have a top wall, a bottom wall and an inside surface further comprising adhesive disposed on at least a portion thereof to contact the a nail. In other embodiments, the strips of the present invention include a self-adhesive laminate, shapeable to toe and fingernails, containing a film-forming polymer layer containing at least one plasticizer, a pressure-sensitive adhesive layer located thereon, and a carrier film which covers the pressure-sensitive adhesive layer and can be removed.

In still other embodiments, the present invention includes a transfer adhesive sheet that has a series of precut areas of transfer adhesive for applying a predetermined nail shape to a person's nail. The transfer adhesive tabs may be fabricated as sheet material that includes an adhesive protected by a bottom layer liners positioned on the side of the adhesive, such as adhesives used in securing false plastic finger nail. Preferably the adhesive is just around the periphery of the nail region and more preferably is adhesive that is less adhesive than the adhesives used to adhere fake fingernails to nails (e.g. because the adhesive must merely be sufficient to hold the strips/tabs of the present invention in contact with the nail until the nail polish removing agent can dissolve the polish it contacts, e.g. about 1-2 minutes, more preferably at least about 3 minutes and less than about 10 minutes. Methods of producing such sheet material of transfer adhesive tabs will be apparent (with the guidance herein provided) to those of skill in the art but include the steps of applying an adhesive layer to the surface of a first material—which may be associated with the pad that is to be saturated with acetone or like material. The sheet material may be manufactured in small pieces or in a long piece formed into a roll. Roll material is generally manufactured in a continuous process which is typically more economical than making small pieces such as letter or A4 size or other sizes. The roll can be cut into such smaller sizes if desired. The protective substrate will preferably easily peel away from the adhesive. Preferably the maximum adhesive is on such sheets is five thousandths of an inch and having a thickness about one-half of one thousandth of an inch. In other embodiments, however, the thickness of the pad beneath the outer layer protective layer is fairly thick (like a dime or a penny) to facilitate the absorbance and retention of a sufficient amount of nail polish removing material.

One aspect of various embodiments relates to the use of a solubilized mixture composed of an electron-donating color-developing organic compound selected from pyridines, quinazolines, and bisquinozolines; an electron-accepting compound serving as a color-developer for the above compound; and a reaction medium for coloring and the above compound in a specified temperature range. Such compositions develop fluorescent color of yellow, yellowish orange, orange, reddish orange, or red with a high color density and high color brightness, yet gives no residual color under non-color-developing conditions, and has remarkably improved light resistance. In this regard, color changing embodiments that can be used with the present invention include those set forth in U.S. Pat. No. 5,558,700 to Shibahashi et al., incorporated herein by this reference.

In other embodiments, there is a desire to have the odor of acetone or even non-acetone agents reduced. To accomplish the same, certain embodiments incorporate odour-eliminating products with Cyclodextrins or more preferably, modified β Cyclodextrin as one of its main ingredients. A Febreze-like component can be associated with the strips to achieve the desired deodorization process, which in some embodiments, involve the entrapment of malodour molecules when they complex with Cyclodextrin and are effectively retained to keep their concentration in the air low. This decreases the volatility of the malodour molecules and causes odour elimination. In a preferred embodiment, hydroxypropyl beta-cyclodextrin or HPβCD is employed for such purpose, with such component being preferably associated with the absorbent pad of the strip, such that it is released and active when the nail polish removing agent is released.

It will be appreciated that various know color changing components can be employed such that the breakage of encapsulated or micro-encapsulated beads of one agent is then made available to react with another agent, which may be, for example, impregnated onto the absorbent pad. Thus, one can fine tune and select appropriate color change times by the selection of reactive chemicals that provide a desired color change at a certain time—preferably about 3-10 minutes after application of the strip to the nail.

In terms of a method, in one embodiment a sheet as described above is selected with appropriate pre-determined fingernail or toenail perforated portions. The individual nail contacting portions are then detached from the sheet and the protective bottom laminate is removed to expose the nail contacting surface, i.e. the saturated (or bead containing) pad that is contacted with the polished portion of the person's nail. Preferably there is at least a portion, such as a preferably, of the strip that maintains the strip in place on the nail during a period of at least 30 seconds, more preferably for at least about 2 minutes and more preferably for up to about 10 minutes. This time should be sufficient for the nail polish removing substances employed to dissolve the polish. At such time the strips can be removed from the nail surface and excess or dissolved polish can be further removed with a cloth, tissue or cotton balls. The use of the strips, however, reduces the amount of odor emanating from the person's treated nails as the top-most protective layer of the strip precludes the free evaporation of such acetone or nail polish remover substance.

As designed, a device and method embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A kit for use in the removal of nail polish from a person's nail comprising:

a plurality of preformed curved nail strips each having a top layer comprising a material substantially impervious to acetone, a lower removable protective layer, a frangible layer of an encapsulated nail polish removing agent and an absorbent pad layer, where the absorbent pad layer is located below the top layer and above the removable lower protective layer, and said frangible layer of encapsulated nail polish removing agent is located below said top layer and above said absorbent layer, said curved strips having an adhesive around the periphery of the curved nail strips for placement on a periphery of a user's nail region and said adhesive being sufficient to hold the strips in contact with the nail until the nail polish removing agent dissolves nail polish present on a user's nail;

wherein said nail polish removing agent comprises acetone; and wherein said pad is made of spun laced fabric.

2. The kit as set forth in claim 1, wherein the encapsulated nail polish removing agent is a frangible enclosure that when fractured, releases solvent into the absorbent pad layer.

3. The kit as set forth in claim 1, wherein said strips are similar in size to each of a user's nails.

4. The kit as set forth in claim 1, further comprising at least one odor-reducing component between said top layer and said lower removable protective layer.

5. The kit as set forth in claim 1, wherein said solvent comprises acetone, said acetone being contained in at least one frangible encapsulated structure located between said top layer and said lower removable protective layer, said at least one encapsulated structure, when fractured, releasing its contents onto said absorbent pad layer.

6. The kit as set forth in claim 1, wherein said adhesive is present in a layer having a thickness of five thousandths of an inch, and wherein said absorbent pad has a thickness of less than a penny.

7. The kit as set forth in claim 1, further comprising a layer that includes cyclodextrin between said top layer and said lower removable protective layer.

8. The kit as set forth in claim 1, further comprising a color change component provided in a breakable encapsulated enclosure between said top layer and said lower removable protective layer, said color change component comprising reactive chemicals that provide a desired color change at a predetermined time from between three and ten minutes after application of the strips to the person's nail.

9. A method for removal of artificial nail extensions from a user's natural nails, said method comprising the steps:

a) selecting a fingernail removal strip sized to approximate the size of a user's fingernail, curved to conform to a user's nail and configured to have a top layer comprising a material substantially impervious to acetone, a lower removable protective layer, and an absorbent pad layer located below the top layer and above the removable lower protective layer; and a frangible, encapsulated solvent-containing enclosure associated with said absorbent pad layer; said strip having pressure-sensitive adhesive disposed on at least a portion around a periphery of the strip to maintain said strip in position on a person's fingernail for at least 3 minutes;

b) contacting said strip to a user's fingernail such that said adhesive is in contact with a periphery of the user's fingernail;

c) pressing on said frangible, encapsulated solvent-containing enclosure to release said solvent;

d) retaining said strip on the user's fingernail for a time period of at least 3 minutes; and e) removing said strip after at least 3 minutes, wherein the solvent on said absorbent pad removes an artificial nail extension from a user's natural nails.

10. The method of claim 9, wherein said strip is sized so that it does not encompass a user's finger opposite the user's nail.

11. A nail polish remover strip, comprising:

a pre-sized curved strip for one of a toenail or a fingernail, having an adhesive portion around a periphery of the strip that is configured to contact just a periphery of a user's fingernail or toenail, said strip adapted to be applied to a fingernail or toenail having nail polish thereon, and left in contact with a user's fingernail or toenail for a predetermined period of time to dissolve the nail polish thereon, said strip having at least four layers, with a first layer comprising an exterior odor impervious material, a second layer that comprises one of encapsulated acetone or an encapsulated nail polish removing agent, a third layer having a solvent absorbent layer, and a fourth layer having a peelable backing;

wherein the adhesive portion is sufficient to hold the strip in contact with the fingernail or toe nail until the acetone nail polish removing agent dissolves polish present on said user's nail; and wherein the acetone or nail-polish removing agent is encapsulated in a frangible shell.

12. The nail polish remover strip as set forth in claim 11, further comprising a color change indicator included between said top layer and said lower removable protective layer that is adapted to produce, after at least five minutes of contact between the strip and the polished nail, a color change sufficient to indicate to the person that a predetermined dwelling time has transpired.

13. The nail polish remover strip as set forth in claim 11, further comprising a color change indicator included between said top layer and said lower removable protective layer that is adapted to produce, after at least five minutes of contact between the strip and the polished nail, a color change sufficient to indicate to the person that a predetermined dwelling time has transpired.

14. The nail polish remover strip as set forth in claim 11, further comprising said strip having at least one of (i) a color change material that changes color to indicate a predetermined dwelling time sufficient to dissolve the nail polish, and (ii) at least one odor reducing component.

15. The nail polish remover strip as set forth in claim 11, wherein the strip is sized so that it does not encompass a user's finger opposite the user's nail.

16. A method for removal of artificial nail extensions from a user's natural nails, said method comprising the steps: providing a sheet having a plurality of pre-determined fingernail perforated portions formed as individual strips, said strips included on a sheet that has a series of precut strips of a uniform size and shape, said sheet formed into a roll; pulling on the sheet to rotate the roll; selecting a pre-determined individual fingernail contacting perforated portion from said roll; detaching said individual nail contacting perforated portion from the sheet to provide an individual strip having a protective layer that reduces the evaporation of acetone, wherein the protective layer comprises a material substantially impervious to acetone; removing a protective laminate associated with said strip to expose a contacting surface consisting of an absorbent pad, said absorbent pad having a frangible layer of encapsulated acetone and said absorbent pad being adapted to absorb and retain an amount of acetone that is sufficient to remove one of: nail polish on a person's nail; or an artificial nail extension from a user's natural nails, the absorbent pad located below the protective layer, and an adhesive portion around a periphery of said strip; positioning said strip onto a person's nail such that the adhesive portion contacts a periphery of a user's nail; pressing the strip onto the user's nail in a fashion such that the frangible layer of encapsulated acetone is compressed to release acetone onto the absorbent pad; maintaining the strip in place on the user's nail for a period of time lasting at least 30 seconds and for up to 10 minutes; and removing the strip from the user's nail.

17. The method as set forth in claim 16, wherein said step of maintaining comprises retaining said strip on the user's fingernail for a time period of at least 3 minutes, wherein the acetone on said absorbent pad removes an artificial nail extension from a user's natural nails.

18. The method as set forth in claim 16, wherein at least two strips are provided across from each other on said sheet.

19. The method as set forth in claim 16, wherein said strips are similar in size to each of a user's nails.

20. The method as set forth in claim 16, wherein the strips have a thickness of between 0.5 millimeter and 3 millimeters.

21. The method as set forth in claim 16, wherein said step of positioning results in only a user's nail being covered and does not encompass a user's finger opposite the user's nail.

* * * * *